US008832886B2

(12) United States Patent
Riley et al.

(10) Patent No.: US 8,832,886 B2
(45) Date of Patent: Sep. 16, 2014

(54) SYSTEM AND METHOD FOR CONTROLLING AIR MATTRESS INFLATION AND DEFLATION

(75) Inventors: John Joseph Riley, Brookfield, WI (US); David Delory Driscoll, Jr., Milwaukee, WI (US); Susan Marie Hrobar, Brookfield, WI (US); Mark Robert Grobarchik, Brookfield, WI (US)

(73) Assignee: Rapid Air, LLC, Pewaukee, WI (US)

( * ) Notice: Subject to any disclaimer, the term of this patent is extended or adjusted under 35 U.S.C. 154(b) by 437 days.

(21) Appl. No.: 13/196,455

(22) Filed: Aug. 2, 2011

(65) Prior Publication Data

US 2013/0031725 A1 Feb. 7, 2013

(51) Int. Cl.
*A47C 27/08* (2006.01)

(52) U.S. Cl.
USPC ..... 5/713; 5/710

(58) Field of Classification Search
USPC ..... 5/706, 710, 713–714
See application file for complete search history.

(56) References Cited

U.S. PATENT DOCUMENTS

| | | | |
|---|---|---|---|
| 1,061,142 | A | 5/1913 | Tesla |
| 2,823,394 | A | 2/1958 | Smith et al. |
| 3,786,869 | A | 1/1974 | Mcloughlin |
| 3,864,055 | A | 2/1975 | Kletschka et al. |
| 3,935,604 | A | 2/1976 | Collins |
| 3,967,244 | A | 6/1976 | Frese |
| 4,146,049 | A | 3/1979 | Kruse et al. |
| 4,255,081 | A | 3/1981 | Oklejas et al. |
| 4,306,322 | A | 12/1981 | Young et al. |
| 4,335,994 | A | 6/1982 | Gurth |
| 4,347,033 | A | 8/1982 | Possell |
| 4,371,999 | A | 2/1983 | Reid |
| 4,394,784 | A | 7/1983 | Swensen et al. |
| 4,435,864 | A | 3/1984 | Callaway |
| RE31,603 | E | 6/1984 | Christensen |
| 4,514,139 | A | 4/1985 | Gurth |
| 4,531,887 | A | 7/1985 | Klepesch |

(Continued)

FOREIGN PATENT DOCUMENTS

| | | | |
|---|---|---|---|
| CA | 2013550 | A1 | 9/1991 |
| CH | 675936 | A5 | 11/1990 |
| DE | 1529538 | | 3/1970 |
| WO | WO 2009123641 | A1 | 10/2009 |

OTHER PUBLICATIONS

Ametek Technical & Industrial Products, Product Catalog, 133 pages (Undated. Obtained from http://pdf.directindustry.com/pdf/ametek-technical-industrial-products/ametek-blowers/14270-133519.html on Oct. 27, 2011.).

(Continued)

*Primary Examiner* — Fredrick Conley
(74) *Attorney, Agent, or Firm* — Leydig, Voit & Mayer, Ltd.

(57) ABSTRACT

The described system and method allows for the control of inflation and deflation of air mattresses such that fast and accurate deflate times and satisfaction of consumer expectations may be achieved. A combination of empirically-derived deflate profiles, corrected dynamic measurements, and static measurements may be used to achieve fast and accurate deflation to user-defined target pressures. Additionally, a marketing routine that invokes simulated deflation or simulated inflation when deflation or inflation is not necessary but a user is expecting deflation or inflation, respectively, may be used to better satisfy the user's expectations.

14 Claims, 8 Drawing Sheets

(56) References Cited

U.S. PATENT DOCUMENTS

| | | | | |
|---|---|---|---|---|
| 4,621,375 | A | 11/1986 | Simnovec | |
| 4,644,597 | A | 2/1987 | Walker | |
| 4,655,680 | A | 4/1987 | Klepesch | |
| 4,679,264 | A | 7/1987 | Mollura | |
| 4,682,378 | A | 7/1987 | Savenijie | |
| 4,768,920 | A | 9/1988 | Gurth | |
| 4,773,819 | A | 9/1988 | Gurth | |
| 4,829,616 | A | 5/1989 | Walker | |
| 4,882,800 | A | 11/1989 | Schueler | |
| 4,901,386 | A | 2/1990 | Lane | |
| 4,908,895 | A | 3/1990 | Walker | |
| 4,940,385 | A | 7/1990 | Gurth | |
| 4,962,522 | A | 10/1990 | Marian | |
| 4,989,280 | A | 2/1991 | Bair | |
| 5,020,176 | A | 6/1991 | Dotson | |
| 5,049,046 | A | 9/1991 | Escue et al. | |
| 5,052,894 | A | 10/1991 | Rimington | |
| 5,117,233 | A | 5/1992 | Hamos et al. | |
| 5,142,720 | A | 9/1992 | Kelso et al. | |
| 5,165,846 | A | 11/1992 | Possell | |
| 5,193,985 | A | 3/1993 | Escue et al. | |
| 5,201,442 | A | 4/1993 | Bakalian | |
| 5,235,258 | A | 8/1993 | Schuerch | |
| 5,278,455 | A | 1/1994 | Hamos | |
| 5,295,890 | A | 3/1994 | Myers | |
| 5,338,157 | A | 8/1994 | Blomquist | |
| 5,341,820 | A | 8/1994 | Hammett | |
| 5,376,070 | A | 12/1994 | Purvis et al. | |
| 5,381,962 | A | 1/1995 | Teague | |
| 5,383,605 | A | 1/1995 | Teague | |
| 5,383,812 | A | 1/1995 | Tibbles | |
| 5,395,274 | A | 3/1995 | Myers | |
| 5,454,129 | A | 10/1995 | Kell | |
| 5,458,466 | A | 10/1995 | Mills | |
| 5,470,197 | A | 11/1995 | Carfarelli | |
| 5,474,486 | A | 12/1995 | Chilton et al. | |
| 5,482,446 | A | 1/1996 | Williamson et al. | |
| 5,485,408 | A | 1/1996 | Blomquist | |
| 5,497,520 | A | 3/1996 | Kunz et al. | |
| 5,509,154 | A | 4/1996 | Shafer et al. | |
| 5,581,828 | A | 12/1996 | Price | |
| 5,588,811 | A | 12/1996 | Price | |
| 5,606,756 | A | 3/1997 | Price | |
| 5,630,710 | A | 5/1997 | Tune et al. | |
| 5,898,963 | A | 5/1999 | Larson | |
| 5,903,941 | A | 5/1999 | Shafer et al. | |
| 5,948,303 | A | 9/1999 | Larson | |
| 6,016,582 | A | 1/2000 | Larson | |
| 6,047,423 | A | 4/2000 | Larson | |
| 6,058,537 | A | 5/2000 | Larson | |
| 6,098,223 | A | 8/2000 | Larson | |
| 6,106,576 | A | 8/2000 | Fromson | |
| 6,112,350 | A | 9/2000 | Larson | |
| 6,115,860 | A * | 9/2000 | Vrzalik | 5/715 |
| 6,132,080 | A | 10/2000 | Gurth | |
| 6,161,231 | A | 12/2000 | Kraft et al. | |
| 6,163,907 | A | 12/2000 | Larson | |
| 6,224,325 | B1 | 5/2001 | Conrad et al. | |
| 6,568,011 | B2 | 5/2003 | Fisher et al. | |
| 6,671,910 | B2 | 1/2004 | Hsu et al. | |
| 6,686,711 | B2 | 2/2004 | Rose et al. | |
| 6,804,848 | B1 | 10/2004 | Rose | |
| 7,097,416 | B2 | 8/2006 | Gurth | |
| 7,192,244 | B2 | 3/2007 | Grande, III et al. | |
| 7,225,488 | B2 * | 6/2007 | Wu | 5/713 |
| 7,886,387 | B2 | 2/2011 | Riley et al. | |
| 2006/0216149 | A1 | 9/2006 | Wilson | |
| 2006/0291997 | A1 | 12/2006 | Wilson | |
| 2007/0092369 | A1 | 4/2007 | Wilson | |
| 2007/0227594 | A1 | 10/2007 | Chaffee | |
| 2008/0232982 | A1 | 9/2008 | Boyd et al. | |
| 2009/0314354 | A1 | 12/2009 | Chaffee | |
| 2011/0073202 | A1 | 3/2011 | Feingold et al. | |
| 2011/0138539 | A1 | 6/2011 | Mahoney et al. | |
| 2011/0265898 | A1 | 11/2011 | Driscoll, Jr. et al. | |

OTHER PUBLICATIONS

Izraelev et al,, "A Passively-Suspended Tesla Pump Left Ventricular Assist Device, NIH Public Access Author Manuscript", *ASAIO J.*, Author Manuscript; available in PMC Nov. 1, 2010, pp. 1-17.

Barske, "Investigations on the Pumping Affect of Rotating Discs", *Proc Instn Mech Engrs*, vol. 189 36/75 (1975), pp. 341-349.

Melanson, Donald, "Novel Concepts' ThinSink claims title of world's thinnest air-cooled heat sink", *Engadget.*, retrieved from http://www.engadget.com/2011/05/09/novel-concepts-thinsink-claims-title-of-worlds-thinnest-air-co/ on Oct. 27, 2011 (7 pages total).

Novel Concepts, Inc., "Heat Sinks, Heat Spreaders, Peltier Coolers, Cold Plates, Heat Pipes, ThinSink", retrieved from http://www.novelconceptsinc.com/thinsink.htm on Oct. 27, 2011 (2 pages).

*Instrumentation and Controls Series E*, Prentice-Hall Electrical Engineering Series, Chapter 5, "Basic Control Actions and Industrial Automatic Controls", pp. 151-215, Copyright 1970 (73 Pages Totoal).

*Instrumentation and Controls Series E*, Prentice-Hall Electrical Engineering Series, Chapter 6, "Tranisent-Response Analysis", pp. 216-282, Copyright 1970, (Total pp. 76).

Chapra, Steven C., et al., "*Numerical Methods for Engineers with Personal Computer Applications*", Chapter 4, "Curve Fitting ", pp. 275-345, total pp. 37, ISBN 0-07-010664-9, Copyright 1985 to McGraw-Hill, Inc.

Chapra, Steven C., et al., "*Numerical Methods for Engineers with Personal Computer Applications*", Chapter 4, "Curve Fitting", pp. 275-345, total pp. 37, ISBN 0-07-010664-9, Copyright 1985 to McGraw-Hill, Inc.

* cited by examiner

SYSTEM AND METHOD FOR CONTROLLING AIR MATTRESS INFLATION AND DEFLATION

FIELD OF INVENTION

The present invention relates to air beds. Particularly, it relates to a system and method for controlling the inflation and deflation of air mattresses.

BACKGROUND OF THE INVENTION

Commercial airbeds have been growing steadily in popularity. Many types of airbeds have been developed for a variety of applications over the years, ranging from simple and inexpensive airbeds that are convenient for temporary use (such as for house guests and on camping trips), home-use airbeds that replace conventional mattresses in the home, to highly sophisticated medical airbeds with special applications (such as preventing bedsores for immobile patients). With respect to home-use and medical airbeds, more and more consumers are turning to these types of airbeds for the flexibility in firmness that they offer, allowing consumers to adjust their mattresses to best suit their preferences.

Conventional control systems for these commercial airbeds have generally been imprecise and subject to a certain degree of inaccuracy. To avoid this problem, certain systems rely on an arbitrary number scale where a user simply chooses numbers and adjusts that number according to the user's needs to change the pressure within the mattress chamber. Other systems merely use large pressure increments (e.g. only allowing a consumer to choose pressure settings at increments of 0.05 psi) to hide the inability of the system to achieve more precise target pressures. Furthermore, with respect to deflating a mattress in particular, achieving a target pressure may take an undesirably large amount of time (e.g. up to around five minutes or more).

Given the deficiencies of the existing technology, it is an object underlying certain embodiments of the described principles to provide a system and method for controlling the inflation and deflation of an air mattress to quickly and accurately achieve user-inputted target pressures. However, while this is an object underlying certain embodiments of the invention, it will be appreciated that the invention is not limited to systems that solve the problems noted herein. Moreover, the inventors have created the above body of information for the convenience of the reader; the foregoing is a discussion of problems discovered and/or appreciated by the inventors, and is not an attempt to review or catalog the prior art.

BRIEF SUMMARY OF THE INVENTION

The present invention is directed to a system and method for controlling the inflation and deflation of air mattresses that allows for fast and accurate deflate times and satisfaction of consumer expectations. In one embodiment, a control unit of an airbed system receives a user input corresponding to a target pressure, deflation is performed if the target pressure is less than a current pressure of the air mattress chamber, an estimated deflate time is determined based on the current pressure, target pressure, and a deflate profile, dynamic measurements corrected by a deflate correction factor are performed during deflation, and the deflation is stopped and a static pressure measurement is performed if a condition based on the estimated time and/or dynamic pressure measurements is met. If a static measurement returns a result that is above the target pressure, the process may be repeated with a new estimated time to target pressure. The amount of times that the process may be repeated may be limited by a loop counter.

The control unit may select a different deflate profile and re-estimate the deflate time to the target profile if the dynamic measurements indicate that a different deflate profile better matches the progress shown by the dynamic measurements. At least two deflate profiles are used, preferably including one corresponding to deflation without weight on an air mattress and one corresponding to deflation with weight on an air mattress. The deflate profiles and deflate correction factor may be determined based on empirical data and stored on a tangible, non-transient computer-readable medium at the control unit. Instructions for performing the process described above may also be stored on the computer-readable medium.

In a further embodiment, the control unit may further include a marketing routine for simulating inflate or deflate under certain circumstances to match airbed performance with consumer expectations. After the control unit receives a user input, the control unit determines whether a condition for performing simulated inflate or deflate has been met, and if it has been met, it performs a simulated inflate or deflate that does not affect the pressure in the air mattress rather than performing a normal inflate or deflate operation. A condition for performing simulated inflate may be when the target pressure is less than or equal to the current pressure and the existing user setting on the user remote is less than the target pressure (meaning that the user is expecting an inflate but the control unit would ordinarily have performed a deflate or done nothing). A condition for performing simulated deflate may be when the target pressure is greater than or equal to the current pressure and the existing user setting is greater than the target pressure (meaning that the user is expecting a deflate but the control unit would ordinarily have performed an inflate or done nothing). In a further embodiment, the performance of a simulated deflate or inflate may further be limited to when the difference between the current pressure and the target pressure does not exceed a predetermined margin.

Other objects and advantages of the invention will become apparent upon reading the following detailed description and upon reference to the drawings.

BRIEF DESCRIPTION OF THE SEVERAL VIEWS OF THE DRAWING(S)

DETAILED DESCRIPTION OF THE INVENTION

Figure 1:
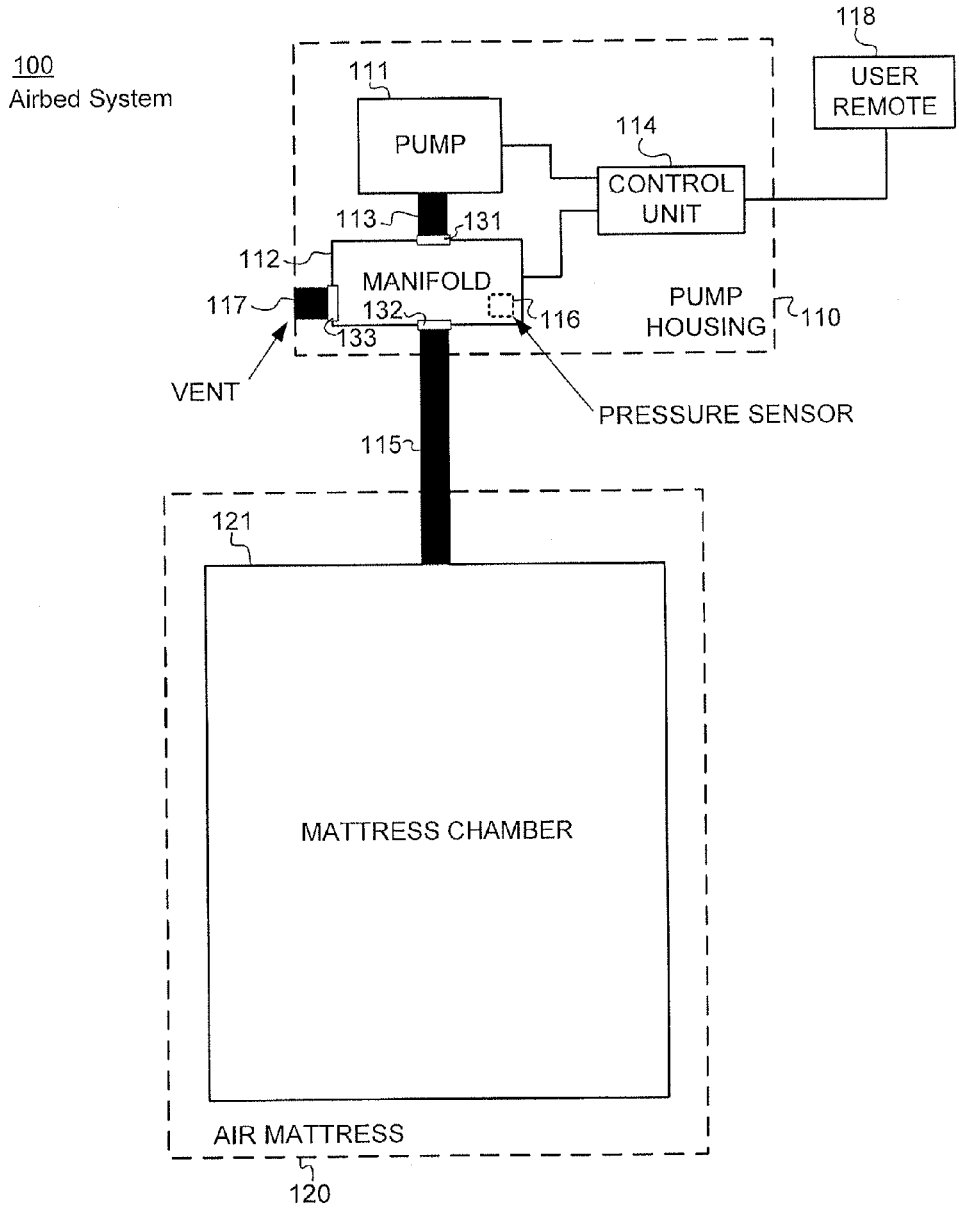
FIG. 1 is a schematic diagram of an airbed environment useable in embodiments of the described principles.

Before discussing the details of the invention and the environment wherein the invention may be used, a brief overview is given to guide the reader. In general terms, not intended to limit the claims, the invention is directed to a system and method for controlling the inflation and deflation of an air mattress. With respect to deflation in particular, one or more deflate profiles may be used together with dynamic measurements to increase the speed and accuracy of deflation to a user-specified pressure. Additionally, a "marketing routine" may be added to the control programming of an airbed system for both inflation and deflation to ensure that the operation of the air bed matches up with user expectations.

Two types of pressure measurements are referenced herein: dynamic measurements and static measurements. For clarity, dynamic measurements refer to readings taken by a pressure sensor at a manifold while air is flowing corrected by a deflate correction factor (i.e. while the air mattress is being deflated), and static measurements refer to readings taken while the air is generally not flowing and the pressure at the location of the pressure sensor is relatively stable (e.g. taking a reading after closing the appropriate valves to isolate a mattress chamber from the pump and from atmosphere). Dynamic measurements taken from a pressure sensor at a manifold for the purpose of determining pressure at the air mattress chamber (even after application of a correction factor) are inherently less accurate than static measurements taken at the manifold after the pressure in the air mattress chamber and manifold have stabilized, but static measurements cannot be taken while a mattress is being inflated or deflated. It will be appreciated that dynamic and static measurements may be the average of a plurality of individual pressure measurements taken over a unit of time (e.g. one dynamic "measurement" may be the average of a plurality of measurements taken over one unit of time, or one dynamic "measurement" may be the average of a plurality of readings taken over one unit of time corrected by the correction factor).

The length of time associated with taking static measurements is particularly problematic with respect to deflation. Conventional deflation relies on opening valves such that a chamber to be deflated is connected to atmosphere. The rate of change in pressure during deflate is much slower than the rate of change in pressure during inflate, where a pump is actively pushing air into the chamber. To decrease the total time needed to reach a target pressure during deflate, the number of static pressure measurements needed to reach the target should be minimized. The present invention accomplishes this by utilizing a combination of dynamic and static measurements, along with pre-defined deflation profiles stored at the control unit. Additionally, the present invention includes robust programming logic (i.e. the marketing routine) that allows the airbed system to better satisfy user expectations in certain exceptional circumstances.

Given this overview, an exemplary environment in which the invention may operate is described hereinafter. It will be appreciated that the described environment is an example, and does not imply any limitation regarding the use of other environments to practice the invention. With reference to FIG. 1 there is shown an example of an airbed system 100 that may be used with the present method and system and generally includes a pump housing 110 having a pump 111, manifold 112 and control unit 114, and an air mattress 120 having at least one mattress chamber 121. It should be appreciated that the overall architecture, as well as the individual components of a system such as that shown here are generally known in the art.

The pump 111 may be any type of pump suitable for pumping air into an air mattress, including but not limited to squirrel-cage blowers and diaphragm pumps. The pump 111 is connected to the manifold 112 via a connection tube 113 with a valve 131 positioned at the connection of the tube 113 and the manifold 112. It will be appreciated that in other embodiments, the pump 111 may be directly connected to the manifold 112 without a connection tube 113 and that the valve 131 may be positioned at any appropriate place between the pump outlet and the manifold chamber. The manifold 112 may be a conventional manifold with a manifold chamber with appropriate connections to a vent 117, the outlet of the pump 111, and the air mattress chamber 121. The manifold 112 preferably includes a pressure sensor 116 (e.g. a ported 1.45 psi RoHS-compliant pressure sensor), as well as a valve 133 leading to the vent 117 (the vent may be a connection tube or merely an opening connecting the manifold chamber to atmosphere) and another valve 132 leading to a connection tube 115 and mattress chamber 121 within the air mattress 120. It will be appreciated that the pressure sensor 116 may be positioned elsewhere, but is preferably located within the manifold chamber (particularly advantageous for systems where the air mattress has more than one mattress chamber).

The control unit 114 communicates with the pump 111, valves 131, 132 and 133, the pressure sensor 116, and the user remote 118 to control the deflate and inflate operations of the airbed system. Specifically, the control unit 114 may open and close the valves, turn the pump on and off, receive pressure readings from the pressure sensor 116, receive user input from the user remote 118, and cause information to be displayed on a display on the user remote 118. The user remote 118 preferably includes a display that is capable of displaying a target pressure input by the user, the current pressure within the chamber (as obtained through a previous or new static measurement), and/or other relevant information to the user, as well as "up" and "down" buttons for the user to adjust a target pressure (and additional zone selection buttons for systems where the air mattress has more than one mattress chamber). It will be appreciated that other methods of user input may be used, such as having a number pad.

Figure 1A:
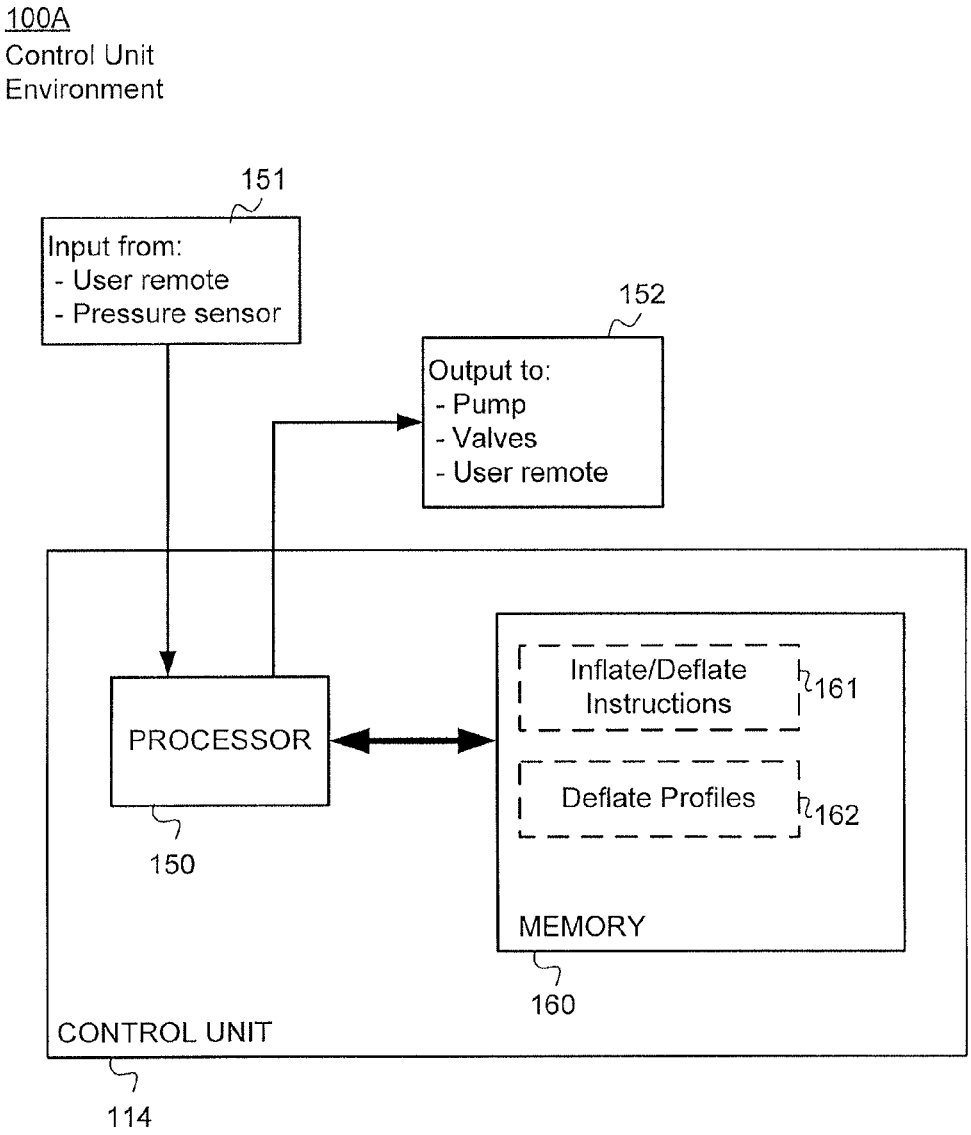
FIG. 1A is a schematic diagram of a control unit in the airbed environment of FIG. 1.

FIG. 1A is a schematic diagram 100A of the control unit 114 of FIG. 1. The control unit 114 includes a processor 150 (e.g. an 8-bit PIC16F88 microcontroller) and a tangible non-transient computer-readable medium 160 (e.g., RAM, ROM, PROM, volatile, nonvolatile, or other electronic memory mechanism) with instructions stored thereon. It will be appreciated by one skilled in the art that the execution of the various machine-implemented processes and steps described herein may occur via the execution of computer-executable instructions stored on the computer-readable medium. Thus, for example, the operation of the pump and the opening and closing of valves during inflate and deflate operations may be executed according to stored applications or instructions 161 at the memory 160 of the control unit 114. It will further be appreciated that the deflate profiles 162 and correction factor (s) and other variables and information described herein may be stored on the computer-readable medium. The control unit 114 may receive inputs 151 from the user remote 118 (e.g., user inputs corresponding to target pressures) and the pressure sensor 116 (e.g., pressure readings), and may output 152 information or control signals to the pump 111, valves 131, 132 and 133, and to the user remote 118 (e.g. current pressure, if the user remote is configured to display current pressure in addition to the user-input pressure).

While the system 100 depicted by FIG. 1 shows an air mattress 120 having only one mattress chamber 121, it will be appreciated that the principles described herein may be applied to other environments, including airbed systems having multiple mattress chambers. One such exemplary system is described in detail by U.S. Pat. No. 7,886,387, titled MULTIPLE CONFIGURATION AIR MATTRESS PUMP SYSTEM to Riley (hereinafter "Riley"), which is incorporated herein by reference in its entirety. It will be appreciated by one skilled in the art that the teachings herein with respect to generation of deflation profiles and calculation of a deflate correction factor may be extended to such systems having multiple zones (i.e. multiple chambers in the air mattress) by developing separate deflate profiles and correction factors for each zone.

Figure 2:
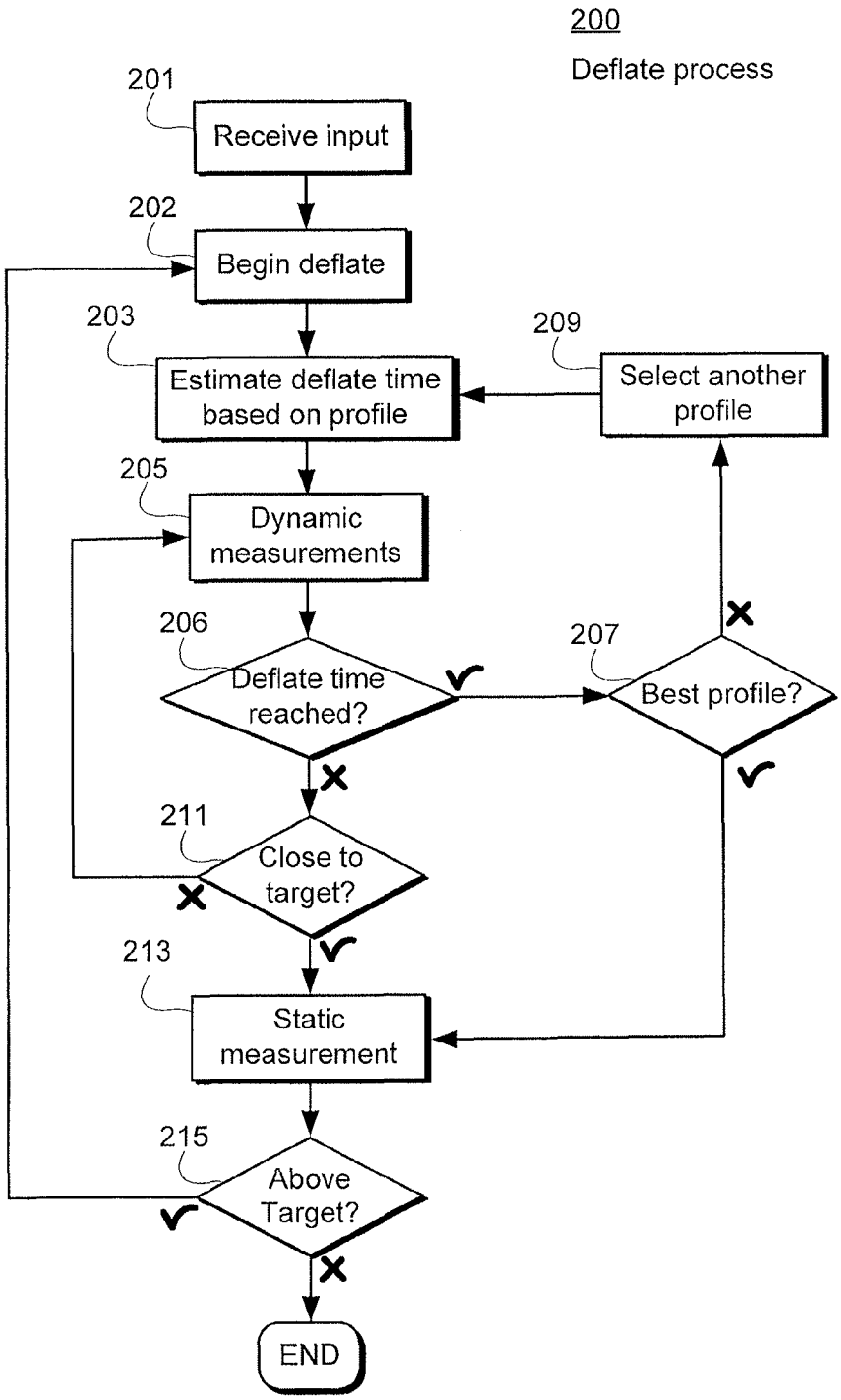
FIG. 2 is a flowchart depicting a process for quickly and accurately deflating an air mattress to a target pressure in accordance with an embodiment of the described principles.

With further reference to the architecture of FIG. 1, and turning more specifically to FIG. 2, a process 200 for controlling the deflation of mattress chamber 121 is depicted. First, a user inputs a target pressure on the user remote 118 that is lower than the current pressure setting displayed by the remote 118 (201) (e.g. the user wants to deflate the mattress from a setting of 0.75 psi to 0.4 psi). Upon receiving an input, it is preferable to have the control unit 114 immediately take a static pressure measurement to determine the starting pressure (i.e. the current pressure in the mattress chamber). However, it will be appreciated that, although preferable, this is not necessary because a previously obtained static measurement may also be used as the starting pressure. The control unit 114 then begins deflating (202) (i.e. by closing valve 131 and opening valves 133 and 132) and estimates a deflate time based on a deflate profile stored at the control unit 114 (203). It should be noted that, generally, the current pressure setting on the remote 118 should approximately be equal to the current pressure in the air mattress chamber (as obtained through a previous static measurement or new static measurement), but there may arise situations where the current pressure setting on the remote is not equal to the current pressure in the air mattress chamber. For these situations, see the below discussion regarding the marketing routine.

In one embodiment, two deflate profiles are used: one "weight-on" deflate profile corresponding to expected deflation times with a body lying on a mattress (similar to or the same as the air mattress 120), and one "weight-off" deflate profile corresponding to expected deflation times without a body lying on a mattress (similar to or the same as the air mattress 120). These deflate profiles may be stored as sets of data in the form of tables, curves, or any other suitable format, such that the control unit 114 is able to estimate the amount of time it will take to reach the target pressure from the current pressure based on a deflate profile. For example, if the weight-on profile is selected, the control unit 114 may determine that the estimated deflate time from 0.75 psi to 0.4 psi is 40 seconds, and if the weight-off profile is selected, the control unit 114 may determine that the estimated deflate time from 0.75 psi to 0.4 psi is 20 seconds. In a preferred embodiment, the deflate profile with the fastest deflate times may be selected initially as a default, but it will be appreciated that this is not a requirement, since one skilled in the art could easily redesign the process such that the check for whether the selected profile is the best profile 207 may be performed elsewhere in the process.

For exemplary purposes, assume that a body is lying on the air mattress 120. The weight-off profile is selected initially and an estimated deflate time of 20 seconds is determined 203. During deflate, dynamic measurements (measurements of the pressure within the manifold chamber taken by pressure sensor 116 and corrected by a deflate correction factor at the control unit 114) are performed 205. Since there is a body lying on the air mattress 120, the actual deflation of the mattress will be slower than the estimated deflate time of 20 seconds. Note that although this seems counter-intuitive, this has been empirically shown to be true and may be attributable to the amount of air inside an air mattress chamber 121 without a body on it at 0.75 psi being different from the amount of air inside an air mattress chamber 121 with a body on it at 0.75 psi and/or the fluid resistance constricting the air flow caused by the connecting tubes 113, 115 and vent 117.

Thus, the estimated deflate time of 20 seconds is reached (206), and the control unit 114 determines whether the best profile was in use (207). Since the dynamic measurements will show that, after 20 seconds, the dynamic measurement of the pressure within the air mattress is closer to the weight-on profile than the weight-off profile (i.e. the expected pressure after 20 seconds according to the weight-on profile would be closer to the dynamically measured pressure than the expected pressure after 20 seconds according to the weight-off profile), the weight-off profile is not the best profile (207) and the control unit 114 selects the weight-on profile (209). The deflate time is then re-estimated based on the weight-on profile (203). It will be appreciated that the re-estimated deflate time may be based on an estimate of the time it would take from the initial starting pressure (0.75 psi) to the target pressure (0.40 psi), or it may be based on the time it would take from the dynamic measurement of the current pressure (for example, 0.65 psi) to the target pressure (0.40 psi) plus the amount of time that has already elapsed (or a reset of the elapsed deflate timer). While the former approach may be more accurate where there was a body lying on the mattress to begin with, the latter approach may be more accurate if, during deflate, a person got onto the mattress. However, it will be appreciated that either approach may be used with the present invention still being able to achieve fast and accurate deflation.

Assuming the former approach is used, the re-estimated deflate time is 40 seconds, and since 20 seconds have already elapsed, the new estimated deflate time will be reached in 20 additional seconds (206). However, if before the re-estimated deflate time is reached, the dynamic measurements indicate that the pressure within the air mattress chamber is getting close to the target pressure of 0.4 psi (i.e. the dynamic measurement is within a predetermined amount such as 0.05 or 0.1 psi of the target) 211, the control unit 114 may stop the deflate and take a static measurement (213). The predetermined amount may be varied based on how accurate the dynamic measurements are and may preferably cause the deflate process to stop a small amount short of the target pressure to ensure that it does not deflate past the target pressure. It may achieve this by subtracting a small amount of cushion time from the estimated time (or the cushion time may be built into the values of the deflate profile). However, it will be appreciated that this cushion time is not necessary, particularly with only two deflate profiles, since with two deflate profiles the system will have a tendency to use estimated deflate times that will be lower than the actual deflate times needed (assuming the weight-on deflate profile is based on a person of relatively low weight).

If the dynamic measurements do not indicate that the pressure within the air mattress chamber is getting close to the target pressure of 0.4 psi before the re-estimated deflate time is reached, and the re-estimated deflate time is reached (206), the control unit 114 again determines which profile matches the most recent dynamic measurement or measurements.

Since the weight-on profile is the best, and it is already selected, the control unit 114 stops the deflate and performs a static measurement (213) (i.e. valves 131 and 133 are closed and a pressure reading is taken from pressure sensor 116 when the pressure within the manifold 112 and mattress chamber 121 stabilizes) to check on the progress of the deflate.

In either situation, if the static measurement reveals that the current pressure inside the air mattress chamber 121 is above the target pressure 215, the deflate process is repeated, with the most recently-determined best profile preferably selected for estimation of a deflate time (203). This process, as described above would repeat itself until the control unit 114 determines that the pressure within the mattress chamber is less than or equal to the target pressure based on the static measurement (215), at which point the control unit 114 determines that no more deflation is necessary with respect to the received user input (i.e. the result of the static measurement is satisfactory). Generally the process need not be performed more than two or three times to achieve a satisfactory target pressure (e.g. within 0.01 psi). Thus, it will be appreciated that static measurements are performed when one of the following two conditions is met: (1) the estimated deflate time is reached with the best profile selected; or (2) the dynamic measurements indicate that the air mattress chamber pressure is close to the target pressure before the estimated deflate time is reached. It will further be appreciated that in other embodiments, the process may be modified such that static measurements are performed any time the estimated deflate time is reached (for example, in an embodiment where the check for whether the best profile takes place before the estimated deflate time is reached).

It will be appreciated that after deflation is complete, the manifold chamber and mattress chamber 121 may be isolated from one another by the valve 132, and the manifold chamber may be vented to atmospheric pressure by opening the valve 133 connected to the vent 117. This allows each new inflate or deflate operation based on a new user input to begin with the manifold chamber at atmospheric pressure rather than having a variable starting point, and may be particularly preferable for air mattresses having multiple chambers that can be inflated or deflated independently.

The deflate profiles are generated empirically based on experimental deflation trials with the same system design (i.e. same manifold, valves, connection tubing, and air mattress set-up) by conducting numerous deflates from one pressure to another and recording the amount of time needed. Because the rate of deflation depends on the specific parameters of each system, deflate profiles generated in this manner are specific to a particular system set-up, but it will be appreciated that the deflate profiles will still be valid if the system parameters vary within an acceptable degree. Other variables that cannot be controlled for also affect deflate speed, such as the size of a body lying on the mattress or even the distribution of weight across the mattress. However, because the deflate profiles are intended as guidelines, some variation is acceptable. For example, deflate profiles derived from a king mattress may be useable with a system for a queen mattress and vice-versa.

In the embodiment described above with two deflate profiles, the weight-on profile was derived using a person of relatively small size (about 5'4" and 120 pounds). It will be appreciated that more than two deflate profiles may be used, for example, to accommodate children, larger people, or multiple people. However, based on the empirical data, it was determined that while the difference in deflate times between having no weight on the air mattress and having an average person lay on the air mattress was significant, the variation between having persons of different weights lay on the air mattress was not as significant, and thus a two-profile system worked well for a wide range of users. It was particularly advantageous to use a person of relatively low weight, because when users of relatively higher weight lay on the air mattress, the estimated deflate times determined based on the weight-on deflate profile are slightly shorter than the actual deflate time needed, which prevents overshooting of the target pressure (without including a cushion time). Thus, it will be appreciated that additional deflate profiles for situations other than the weight-on and weight-off situations may be implemented in further embodiments, but such additional deflate profiles are not necessary to achieve the benefits of fast and accurate deflation. Furthermore, the use of only two deflate profiles requires less processing power and programming complexity than the use of more than two deflate profiles.

To generate the deflate profiles empirically, it was first verified that readings during deflate from additional pressure sensors placed in the air mattress chamber 121 were substantially equal to corresponding static pressure readings taken at the pressure sensor 116 in the manifold 112 with the vent valve 133 closed and the pressure stabilized. Through a plurality of trials, it was verified that readings during deflate from pressure sensors within the air mattress chamber accurately represented the pressure within the air mattress chamber (according to corresponding static measurements) and that the precise position of the pressure sensors within the air mattress chamber did not impact this accuracy. Using this information, a large number of trials was run from a variety of starting pressures to a variety of ending pressures while collecting data regarding the pressure within the air mattress chamber 121, corresponding dynamic readings from the manifold chamber, and deflation times required to go from one pressure to another pressure. Trials were run for both the situation where there was no weight on the air mattress and where a person was lying on the air mattress. Using this data, weight-on and weight-off deflate profiles and a deflate correction factor for dynamic measurements were generated by compiling the raw data and averaging the deflate time information from multiple trial runs to obtain a "best fit" data set. It will be appreciated that best fit deflate profiles may also be generated through conventional regression analysis as is known by those skilled in the art applied to the raw data. It will be appreciated that the cost and increased complexity of having a pressure sensor within the air mattress chamber is not preferred for commercial implementation, and thus is only used within these experimental set-ups in the empirical generation of the deflate profiles and deflate correction factor. Furthermore, it will be appreciated that it may be possible to develop these profiles and correction factor mathematically (rather than empirically), but it is simpler and likely more reliable to do so empirically.

The generation of the deflate profiles may be understood better in the context of a simplified hypothetical example. Given a system set-up as shown in FIG. 1, an additional pressure sensor is added to the air mattress chamber 121. Numerous trial runs are conducted while collecting data regarding the pressure within the air mattress chamber, corresponding dynamic readings from the manifold chamber, and deflation times required to go from one pressure to another pressure, and the results of the trial runs are compiled into a raw data table.

Table I below provides a hypothetical example of an excerpt of such a raw data table. It will be appreciated that Table I, with only a few random hypothetical trials shown, is for illustration purposes only and that actual trial runs will produce much more data and at much smaller intervals.

TABLE I

Hypothetical Raw Deflation Data

| Weight-off | | | | Weight-on | | | |
|---|---|---|---|---|---|---|---|
| Trial | Chamber (psi) | Manifold (psi) | Time (s) | Trial | Chamber (psi) | Manifold (psi) | Time (s) |
| 1 | 1.0 | n/a | 0 | 4 | 1.0 | n/a | 0 |
| | 0.8 | 0.4 | 5 | | 0.8 | 0.4 | 20 |
| | 0.6 | 0.3 | 10 | | 0.6 | 0.3 | 40 |
| | 0.4 | 0.2 | 15 | | 0.4 | 0.2 | 60 |
| | 0.2 | 0.1 | 20 | | 0.2 | 0.1 | 80 |
| 2 | 0.9 | n/a | 0 | 5 | 0.9 | n/a | 0 |
| | 0.6 | 0.3 | 7.5 | | 0.6 | 0.3 | 30 |
| | 0.3 | 0.15 | 15 | | 0.3 | 0.15 | 60 |
| 3 | 0.7 | n/a | 0 | 6 | 0.7 | n/a | 0 |
| | 0.5 | 0.25 | 5 | | 0.5 | 0.25 | 20 |
| | 0.3 | 0.15 | 10 | | 0.3 | 0.15 | 40 |
| | 0.1 | 0.05 | 15 | | 0.1 | 0.05 | 60 |

Using this raw data, a best fit curve or data set may be generated such that there is one deflate profile covering an entire range of pressures for each of the weight on and weight off situations. Given the simplified data table above, the deflate profiles generated from a best fit of the raw data in this hypothetical example, if expressed graphically (pressure vs. time), would be straight lines with different slopes with the weight-off graph having a steeper slope than the weight-on graph. The best fit curve or data set of the raw data may be stored as tables representing the two deflate profiles at the control unit as shown in Table II.

TABLE II

Hypothetical Deflate Profiles

| Weight-off | | Weight-on | |
|---|---|---|---|
| Pressure (psi) | Time (s) | Pressure (psi) | Time (s) |
| 1.0 | 0 | 1.0 | 0 |
| 0.9 | 2.5 | 0.9 | 10 |
| 0.8 | 5 | 0.8 | 20 |
| 0.7 | 7.5 | 0.7 | 30 |
| 0.6 | 10 | 0.6 | 40 |
| 0.5 | 12.5 | 0.5 | 50 |
| 0.4 | 15 | 0.4 | 60 |
| 0.3 | 17.5 | 0.3 | 70 |
| 0.2 | 20 | 0.2 | 80 |
| 0.1 | 22.5 | 0.1 | 90 |

Thus, during deflation, if the weight-off profile is selected, the starting pressure is 0.7 psi, and the target pressure is 0.4 psi, the control unit will determine that the estimated deflate time needed to reach the target pressure is 15 s (the time in the weight-off deflate profile at 0.4 psi) minus 7.5 s (the time in the weight-off deflate profile at 0.7 psi) minus a cushion time of, for example, 0.5 s (to prevent possible over-deflation) for a total of an estimated deflate time of 7 seconds. It will be appreciated that the cushion time may alternatively be built into the deflate profile by adding the cushion time to the times in Table II. In a further embodiment, the cushion time may vary based on the pressure (e.g. larger cushion times at higher pressures).

Of course, these deflate profiles and raw data described above in Tables I and II are merely illustrative and simplified for the purpose of clearly showing how the deflate profiles may be obtained empirically. In actual trials, which included a larger, more detailed, and less linear sets of data, it was observed that the time needed to deflate at relatively high pressures (e.g. starting and ending pressures above around 0.4 psi) was relatively fast, and both the weight-on and weight-off deflate profiles (if expressed graphically) had steep slopes and similar deflate times, while the time needed to deflate at relatively low pressures (e.g. starting and ending pressures below around 0.4 psi) was relatively slow, and both deflate profiles (if expressed graphically) had more gradual slopes and a large discrepancy between deflate times. The actual deflate profiles used, if expressed graphically as pressure vs. time, are curves with steep slopes at higher pressures and more gradual slopes at lower pressures, with the weight-on deflate profile corresponding to substantially longer deflate times than the weight-off deflate profile at low pressures.

As mentioned above, the dynamic measurements taken by pressure sensor 116 at the manifold 112 are corrected by a deflate correction factor. This deflate correction factor may be calculated from the experimental trial runs above used to generate the deflate profiles by comparing the pressure within the air mattress chamber 121 during deflate (which was shown to be about the same as a static pressure measurement) to the pressure within the manifold 112 during deflate, and finding a correction factor that would cause the dynamic reading from the manifold 112 to approximately equal the pressure readings from the air mattress chamber 121. In the hypothetical example shown in Table I, the correction factor would be 2, as multiplying the dynamic reading by a factor of 2 results in a dynamic measurement approximately equal to the corresponding pressure readings taken from the air mattress chamber 121.

In further embodiments, a large discrepancy between a dynamic measurement obtained shortly before a static measurement and the static measurement may be utilized to report that an error has occurred. For example, a large discrepancy can indicate that there may be a kink in a connection hose or that something is blocking the vent. The error may be reported to the user on the user remote 118 through a display or some other type of error indicator, or if the control unit is equipped with a network access device, may be transmitted over a network to the user (e.g. notifying the user through e-mail or text message) or to a customer service center).

Although the process 200 described above with respect to FIG. 2 generally yields fast and accurate deflation with very few static measurements, further embodiments may include additional features for exceptional circumstances where the described system and method might not achieve fast and accurate deflation with only a few static measurements.

Figure 3:
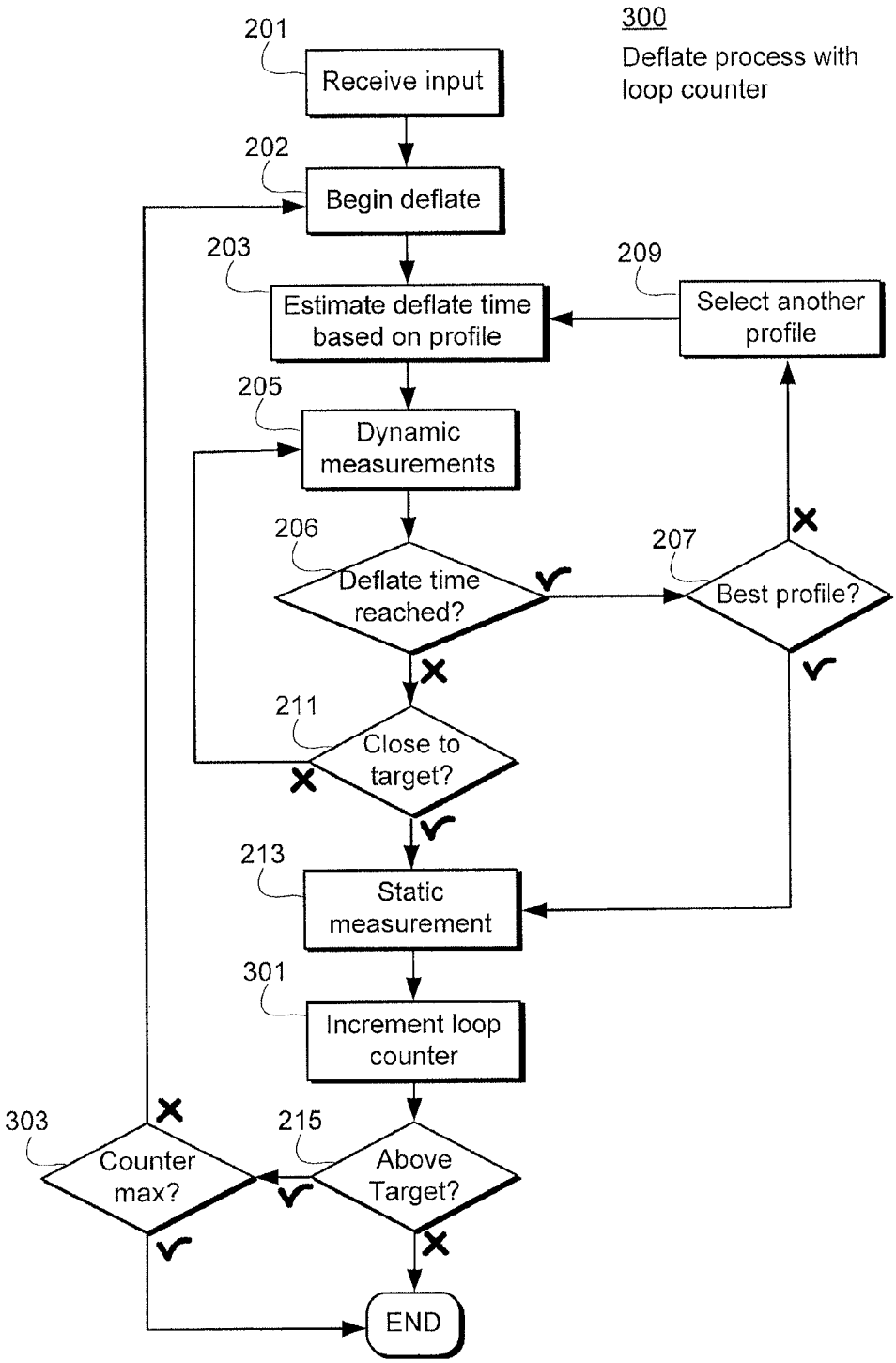
FIG. 3 is a flowchart depicting a process for quickly and accurately deflating an air mattress to a target pressure in accordance with a further embodiment of the described principles.

FIG. 3 depicts a process 300 for deflation, similar to that of FIG. 2, with an additional loop counter feature to limit the number of static measurements that may be taken. With conventional airbeds, the deflate process often takes so long and requires so many static measurements that a user may think that the airbed is broken when the airbed opens and closes valves over and over to take static measurements. To avoid such a situation, the process 300 includes a loop counter that is incremented each time a static measurement is taken (301). If the current pressure is above the target pressure, the control unit first checks whether the loop counter has reached its maximum value before proceeding with another round of deflation with dynamic and static measurements (303). For example, the loop counter maximum may be set to four, and thus the process of taking dynamic and static measurements as depicted in FIG. 3 could be repeated up to four times before being ended by the control unit due to reaching the loop counter maximum. It will be appreciated that the loop counter should be reset to zero after the process 300 is ended or when a user input is received (201).

Figure 4:
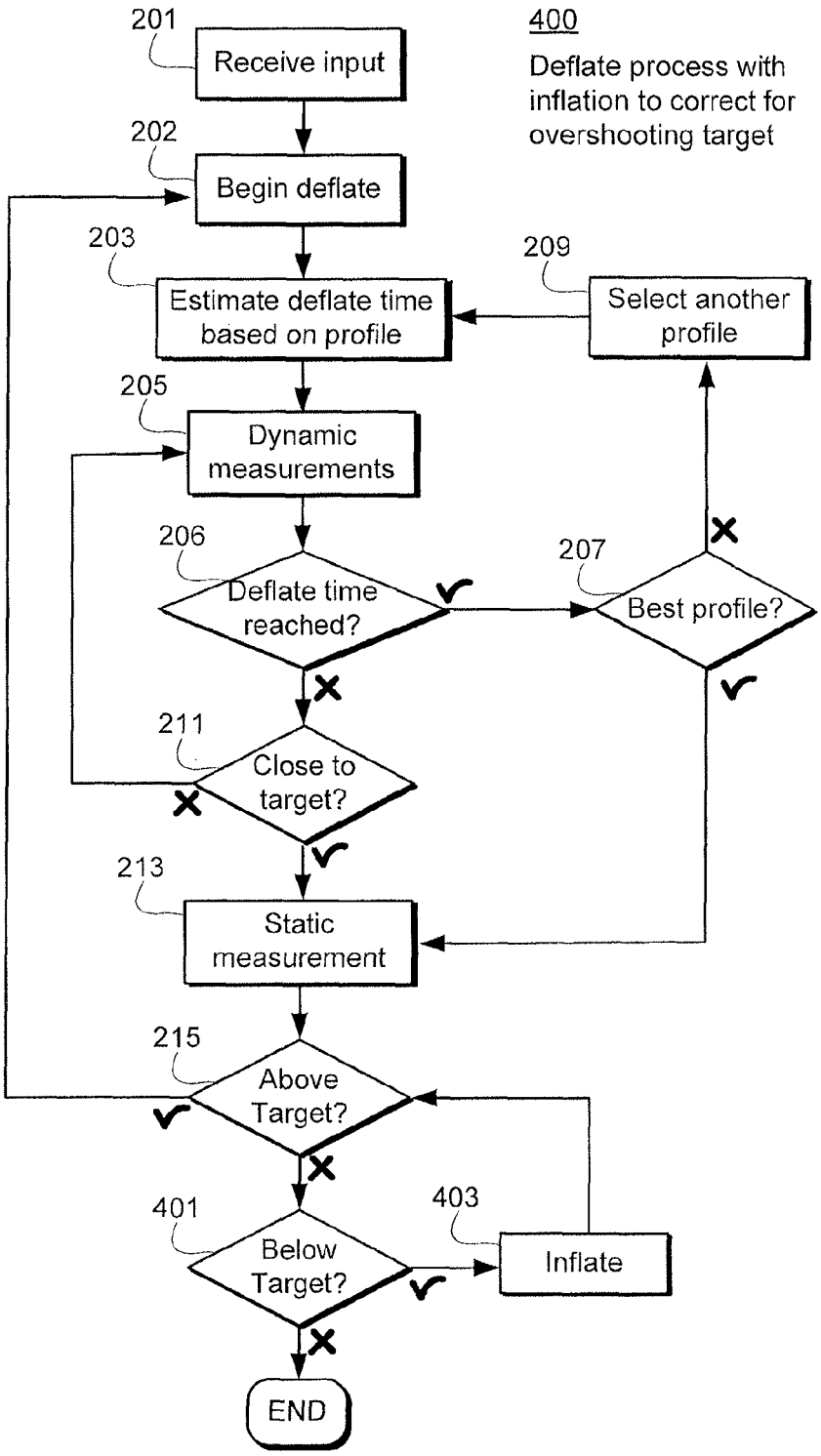
FIG. 4 is a flowchart depicting a process for quickly and accurately deflating an air mattress to a target pressure in accordance with yet another further embodiment of the described principles.

Another further embodiment is depicted by the process for deflation 400 of FIG. 4, which includes the feature of inflating the air mattress chamber 121 back up to the target pressure in the event that the static measurement reveals that the air mattress chamber 121 has been deflated too far and is below the target pressure (401). When the mattress chamber 121 is deflated past the target, the control unit 114 may implement the normal inflate (403) operation of the pump 111 to bring the mattress chamber 121 back up to the target pressure (and if it goes too far and back above the target pressure (215), the mattress chamber 121 may be deflated again (202), and so on until the target pressure is reached). In yet a further embodiment, the control unit 114 may allow a certain degree of leeway in deflation, such that the mattress chamber will only be determined to have been deflated too far below target (401) if it is more than a predetermined number of psi below the target pressure.

Implementations of the architecture of FIG. 1 combined with the process of FIG. 2 are capable of achieving relatively fast deflate times with accuracies of within one or two-hundredths of a psi, and thus user remotes may be designed to give the user the ability to input target pressures in increments of one-hundredth of a psi. However, because user remotes are generally designed to only display the user input pressure (as opposed to the actual current pressure in the mattress chamber), this occasionally results in a user perception problem in situations where an inflate or deflate overshoots the target pressure or where the user creates a discrepancy between the displayed pressure and actual current pressure (as obtained by the control unit through a static measurement) by shifting weight on the mattress or getting on or off the mattress. A discrepancy may also arise in the displayed pressure and the actual current pressure due to changes in atmospheric pressure, as it will be appreciated by one skilled in the art that atmospheric pressures are subject to a significant degree of variation.

For example, a user may input a target pressure of 0.40 psi while the current pressure is 0.75 psi. The air mattress chamber 121 may be deflated down to 0.38 psi (which is too small a difference from 0.40 psi for the user to notice), but the user remote 118 will still display 0.40 psi. Thus, if the user subsequently inputs 0.38 psi or 0.39 psi as the target pressure, the control unit 114 would not deflate further in response to the user's subsequent input, which may lead to the consumer believing that the airbed is not functioning properly. Similarly, in another example, if the current displayed pressure on the user remote is 0.38 psi and the actual pressure within the mattress chamber as measured statically by the pressure sensor 116 comes out to 0.40 psi, a user input of 0.39 psi or 0.40 psi will not result in inflation of the air mattress chamber 121 even if the user expects inflation. In yet another example, the user may be lying on the air mattress while the target pressure and the measured pressure are both at 0.40 psi. If the user gets off of the air mattress, the target pressure displayed on the user remote 118 will still be 0.40 psi, but the measured pressure will now be lower, for example, at 0.35 psi. Thus if the user subsequently inputs 0.37 psi, the air mattress chamber 121 will be inflated to 0.37 psi when the user is expecting it to deflate.

Figure 5:
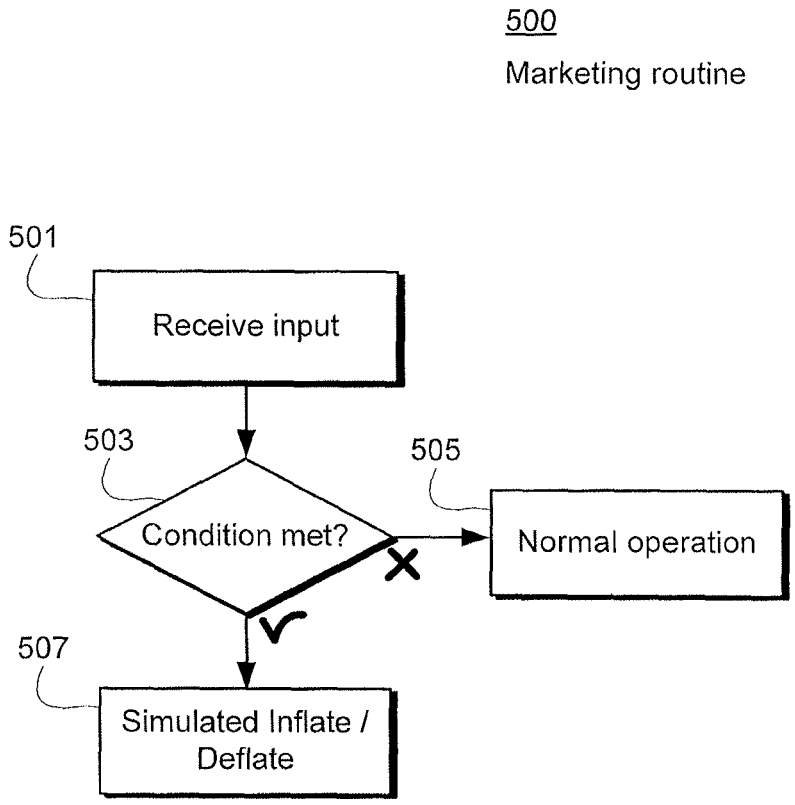
FIG. 5 is a flowchart depicting a general process for simulating user-expected behavior.

FIG. 5 depicts a process 500 that may be implemented in the programming logic of the control unit 114 to deal with such situations, referred to herein as "the marketing routine." After a user input is received (501) (again, a static measurement may be taken here right after the user input is received to determine the current pressure in the mattress chamber 121), the control unit 114 determines whether a situation such as those described above is present 503, and, if so, proceeds with a simulated inflate or deflate operation (507) to match the user expectations. If the situation is not present (503), the control unit 114 behaves normally (505) (i.e. inflation or deflation to the target pressure). A simulated inflation (507) may be performed by closing the valve 132 that connects the manifold 112 to the mattress chamber 121 while opening valves 131 and 133 and running the pump 111, such that the pump 111 is essentially pumping air out through the vent 117 and the pressure within the mattress chamber 121 is unaffected. Similarly, a simulated deflate 507 may be performed by keeping the valve 132 that connects the manifold 112 to the mattress chamber 121 closed while arbitrarily opening and closing other valves (e.g. valve 133) such that the user hears valves opening and closing, but the pressure in the mattress chamber 121 actually remains unchanged. It will be appreciated that this marketing routine for satisfying consumer expectations may be performed in combination with the processes for deflating described by FIGS. 2-4 (the processes for deflating may be implemented as part of a normal deflate operation (505) if the condition for simulated deflate or inflate is not met (503)).

Figure 6:
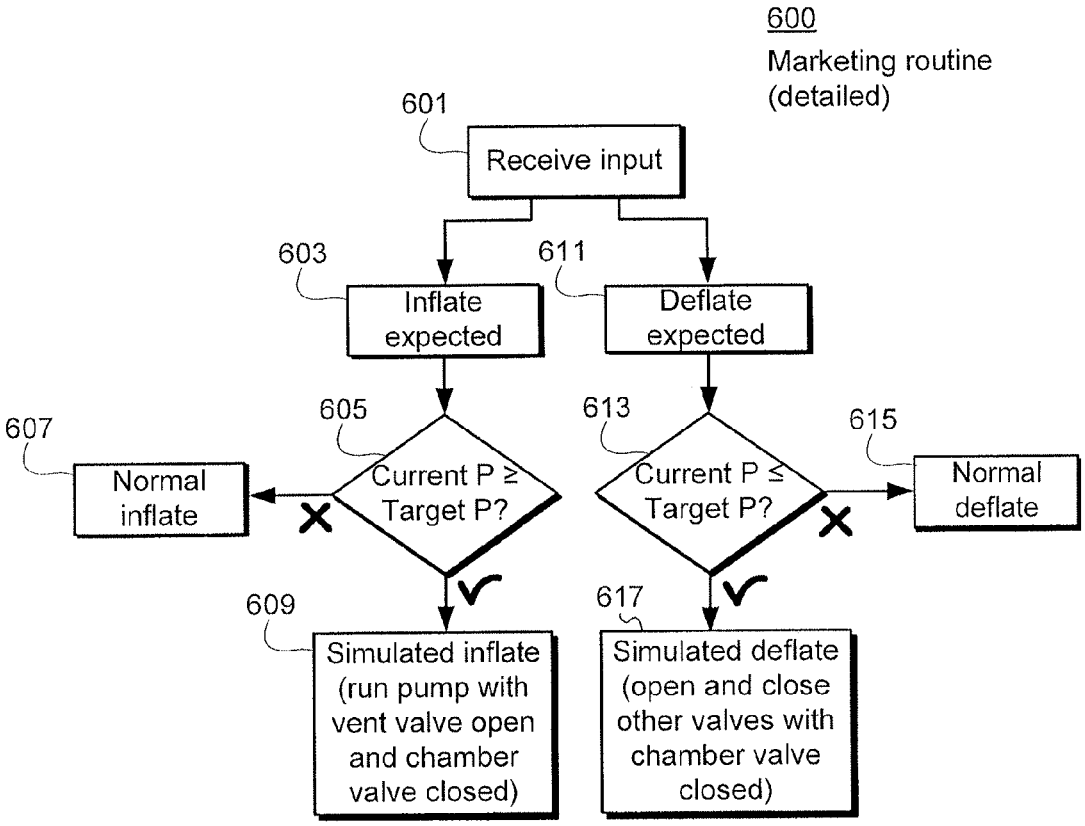
FIG. 6 is a flowchart depicting a process for simulating user-expected behavior in accordance with an embodiment of the described principles.

The process 600 depicted in FIG. 6 illustrates these concepts in further detail. If a user input is received (601) corresponding to an expected inflate (603) (i.e. the target pressure is increased on the user remote 118), and the current pressure of the mattress chamber is greater than or equal to the new target pressure input by the user (605), the control unit 114 simulates inflation by running the pump with the valve between the manifold and chamber closed (609). In a further embodiment, the pump 111 can be run for an amount of time proportional to the amount of expected inflation. If the current pressure of the mattress chamber is less than the new target pressure (605), the control unit 114 actually inflates the mattress chamber 121 according to the user input (607).

Similarly, if a user input is received (601) corresponding to an expected deflate (603) (i.e. the target pressure is decreased on the user remote), and the current pressure of the mattress chamber 121 is less than or equal to the new target pressure input by the user (605), the control unit 114 simulates deflation by opening and closing any valve other than the manifold 112 to mattress chamber 121 valve 132 one or more times with the valve 132 between the manifold 112 and mattress chamber 121 closed (609) (the length of time between opening and closing and the number of times it is opened and closed can be based on the amount of expected deflation). If the current pressure of the mattress chamber 121 is greater than the new target pressure (605), the control unit 114 actually deflates the mattress chamber 112 according to the user input (607).

It will be appreciated that when a simulated inflate or deflate is performed, the actual pressure within the air mattress chamber 121 and the target pressure are getting closer to one other. The simulated deflate or simulated inflate will not significantly affect the pressure within the air mattress chamber 121, which stays the same, but the target pressure input by the user will be closer to the pressure within the air mattress chamber 121, and thus the two values become closer. It will be noted that taking a static measurement after receiving the user input may cause the pressure in the air mattress chamber 121 to decrease very slightly (on the order of a few thousandths of a psi) where the manifold 112 is at atmospheric pressure and the air mattress chamber 121 is above atmospheric pressure before the taking of the static measurement and that the effect of this decrease is generally negligible.

Figure 7:
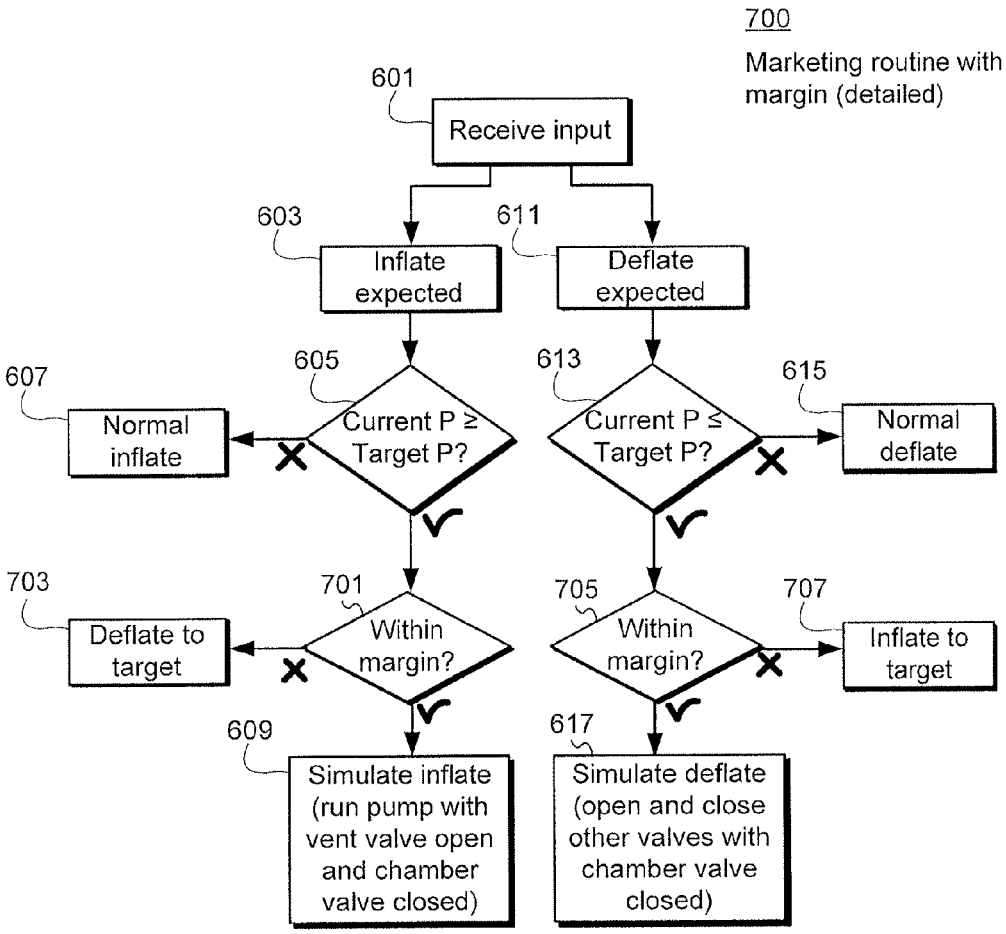
FIG. 7 is a flowchart depicting a process for simulating user-expected behavior in accordance with a further embodiment of the described principles.

In a further embodiment, depicted by FIG. 7, the simulated inflation and deflation may only be applied within a certain margin of discrepancy between the current pressure and the target pressure as shown in the process 700. This feature is optional and may be advantageous when a large discrepancy exists (e.g. if a person gets on or off the mattress and inputs a new target pressure), as it may be more important to correct the large discrepancy than it is to satisfy the user expectation. For example, the margin may be set to a value such as 0.05 psi (a difference of about 0.05 psi is generally perceptible to a person laying on a mattress at relatively low pressures) such that if the discrepancy exceeds 0.05 psi, the control unit 114 will not simulate expected behavior but rather will inflate or deflate to the target pressure. It will be appreciated that other predetermined margins may be used depending on the situation.

In an example with the margin set to 0.05 psi, if the user remote shows 0.40 psi but the actual pressure is 0.60 psi, and the user inputs a target pressure of 0.50 psi 601, the user is expecting an inflate 603, the current pressure is greater than the target pressure 605, but it is not within the margin of 0.05 psi 701 (the difference between the target pressure, 0.50 psi, and the current pressure, 0.60 psi, is 0.10 psi) and thus the control unit deflates to the target pressure of 0.50 psi 703 instead of simulating an inflate 609 even though the user is expecting an inflate. Similarly, in another example with the margin set to 0.05 psi, if the user remote 118 shows 0.60 psi but the actual pressure is 0.40 psi, and the user inputs a target pressure of 0.50 psi (601), the user is expecting a deflate (611), the current pressure is less than the target pressure (613), but it is not within the margin of 0.05 psi (705) (the difference between the target pressure, 0.50 psi, and the current pressure, 0.40 psi, is 0.10 psi) and thus the control unit 114 inflates to the target pressure of 0.50 psi (707) instead of simulating a deflate (617) even though the user is expecting a deflate.

It will thus be appreciated that the described system and method allows for controlling the deflation of an air mattress using a combination of static and dynamic measurements with deflate profiles, in addition to including special routines for simulating inflation and deflation in certain circumstances. It will also be appreciated, however, that the foregoing methods and implementations are merely examples of the inventive principles, and that these illustrate only preferred techniques.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method for deflating an air mattress chamber in an airbed system, the method comprising:

receiving, at a control unit in the airbed system, a user input corresponding to a target pressure;

performing deflation of the air mattress chamber in response to determining that the target pressure is less than a current pressure of the air mattress chamber;

determining an estimated time to target pressure based on the current pressure of the air mattress chamber, the target pressure, and a first deflate profile stored at the control unit;

performing a dynamic pressure measurement while deflation is being performed and applying a deflate correction factor to the dynamic pressure measurement; and stopping the deflation and performing a static pressure measurement after the deflation is stopped in response to determining a condition has been met, wherein the condition is based on at least one of the estimated time to target pressure and the corrected dynamic pressure measurement.

2. The method of claim 1, further comprising:

selecting a second deflate profile based on the corrected dynamic pressure measurement; and determining a new estimated time to target pressure based on the second deflate profile.

3. The method of claim 2, wherein the first deflate profile corresponds to deflation without weight on an air mattress and the second deflate profile corresponds to deflation with weight on the air mattress.

4. The method of claim 3, wherein the first deflate profile, the second deflate profile and the deflate correction factor are predetermined based on empirical data.

5. The method of claim 1, further comprising:

determining that a result of the static measurement is above the target pressure; and in response to determining that the result of the static measurement is above the target pressure, performing deflation based on the result of the static measurement and the target pressure and determining an updated estimated time to target pressure based on the static measurement, the target pressure, and the first deflate profile or a different deflate profile.

6. The method of claim 1, further comprising:

monitoring the number of times the step of stopping the deflation and performing a static measurement is performed with respect to the user input.

7. An airbed system having a control unit, a pump and an air mattress chamber, the control unit comprising a tangible non-transient computer-readable medium with computer-executable instructions stored thereon, the computer-executable instructions comprising instructions for:

receiving a user input corresponding to a target pressure;

performing deflation of the air mattress chamber in response to determining that the target pressure is less than a current pressure of the air mattress chamber;

determining an estimated time to target pressure based on the current pressure of the air mattress chamber, the target pressure, and a first deflate profile stored at the control unit;

performing a dynamic pressure measurement while deflation is being performed and applying a deflate correction factor to the dynamic pressure measurement; and stopping the deflation and performing a static pressure measurement after the deflation is stopped in response to determining a condition has been met, wherein the condition is based on at least one of the estimated time to target pressure and the corrected dynamic pressure measurement.

8. The airbed system of claim 7, the computer-executable instructions further comprising instructions for:

selecting a second deflate profile based on the corrected dynamic pressure measurement; and determining a new estimated time to target pressure based on the second deflate profile.

9. The airbed system of claim 7, wherein the first deflate profile corresponds to deflation without weight on an air mattress and the second deflate profile corresponds to deflation with weight on the air mattress.

10. The airbed system of claim 9, wherein the first deflate profile, the second deflate profile and the deflate correction factor are predetermined based on empirical data.

11. The airbed system of claim 7, the computer-executable instructions further comprising instructions for:

determining that a result of the static measurement is above the target pressure; and in response to determining that the result of the static measurement is above the target pressure, performing deflation based on the result of the static measurement and the target pressure and determining an updated estimated time to target pressure based on the static measurement, the target pressure, and the first deflate profile or a different deflate profile.

12. The airbed system of claim 7, the computer-executable instructions further comprising instructions for:

monitoring the number of times the step of stopping the deflation and performing a static measurement is performed with respect to the user input.

13. A method for simulating inflation of an air mattress chamber using an airbed control system, the method comprising:

receiving, at a control unit in the airbed control system, a user input corresponding to a target pressure for the air mattress chamber, wherein the target pressure is greater than a displayed pressure for the air mattress chamber displayed by the control unit;

measuring the pressure of the air mattress chamber;

determining that the measured pressure of the air mattress chamber is greater than the target pressure; and performing simulated inflation by operating a pump of the air mattress chamber without inflating the air mattress chamber, and updating the displayed pressure to match the target pressure.

14. An airbed system having a control unit, a pump and an air mattress chamber, the control unit comprising a tangible non-transient computer-readable medium with computer-executable instructions stored thereon, the computer-executable instructions comprising instructions for:

receiving a user input corresponding to a target pressure for the air mattress chamber, wherein the target pressure is greater than a displayed pressure for the air mattress chamber displayed by the control unit;

measuring the pressure of the air mattress chamber;

determining that the measured pressure of the air mattress chamber is greater than the target pressure; and performing simulated inflation by operating a pump of the air mattress chamber without inflating the air mattress chamber, and updating the displayed pressure to match the target pressure.

* * * * *

UNITED STATES PATENT AND TRADEMARK OFFICE

CERTIFICATE OF CORRECTION

PATENT NO. : 8,832,886 B2
APPLICATION NO. : 13/196455
DATED : September 16, 2014
INVENTOR(S) : Riley et al.

It is certified that error appears in the above-identified patent and that said Letters Patent is hereby corrected as shown below:

In the Claims

Claim 9, Col. 15, line 29, "The airbed system of claim 7" should read --The airbed system of claim 8--.

Signed and Sealed this
Twenty-third Day of December, 2014

Michelle K. Lee

Michelle K. Lee
*Deputy Director of the United States Patent and Trademark Office*